US005397612A

United States Patent [19]

Small et al.

[11] Patent Number: 5,397,612

[45] Date of Patent: Mar. 14, 1995

[54] COTTON BALE WITHIN A CIRCULAR KNIT COTTON BALE COVER

[76] Inventors: James W. Small, Rte. 3 Piney Point; Ronald E. Small, Rte. 3, Box 273M, both of Norwood, N.C. 28128

[21] Appl. No.: 944,344

[22] Filed: Sep. 14, 1992

[51] Int. Cl.[6] ..... B65D 71/00; D04B 9/06; D04B 7/16

[52] U.S. Cl. ..... 428/36.1; 66/170; 66/200; 66/202; 206/83.5; 428/74; 428/219; 428/225

[58] Field of Search ..... 428/36.1, 225, 35.6, 428/74, 219; 206/83.5; 28/289, 290; 66/170, 200, 202

[56] References Cited

U.S. PATENT DOCUMENTS

| | | | |
|---|---|---|---|
| 2,971,643 | 2/1961 | Farley | 206/83.5 |
| 3,626,726 | 12/1971 | Findlay et al. | 66/170 |
| 3,647,061 | 3/1972 | Kaupin | 206/83.5 |
| 3,674,139 | 7/1972 | Manasian et al. | 206/83.5 |
| 3,926,701 | 12/1975 | Nishiwaki | 156/86 |
| 4,071,138 | 1/1978 | Wright | 206/83.5 |
| 4,557,958 | 12/1985 | Barkis et al. | 428/36 |
| 4,926,851 | 5/1990 | Bulley | 128/157 |
| 5,104,703 | 4/1992 | Rachman et al. | 428/35.6 |

*Primary Examiner*—James D. Withers
*Attorney, Agent, or Firm*—A. Milton Cornwell

[57] ABSTRACT

A high density cotton bale enclosed within a cotton bale cover comprising a fabric circular knitted from yarn consisting essentially of cotton fibers.

7 Claims, 1 Drawing Sheet

COTTON BALE WITHIN A CIRCULAR KNIT COTTON BALE COVER

BACKGROUND OF THE INVENTION

This invention relates to cotton bale covers and, more particularly, to a circular knit cotton cover designed to be used on high density cotton bales.

A wide variety of covers for cotton bales have been used in the past. Those made from jute or burlap are loosely woven permitting contamination of the bale to occur and their low strength causes rips and tears of the cover to develop during handling and storage. Attempts have been made to construct covers of other materials to avoid contamination and tearing. In U.S. Pat. No. 3,647,061 the bale cover disclosed is a laminate of a paper outer layer and a nonwoven cotton inner layer bonded through a polypropylene net with a low melt acrylate. Such construction is expensive and its low air permeability tends to cause mildew. A similar nonwoven cotton laminate cover is shown in U.S. Pat. No. 3,647,139 wherein two nonwoven cotton layers are bonded in a like manner. These covers are also very expensive in comparison to jute and have the further disadvantage of being non-biodegradable. An attempt was then made to produce a knitted cotton cover in U.S. Pat. No. 4,071,138. This bale cover was made from a warp knit fabric having tricot stitch construction. However the bag must be shaped by spiral sewing which adds to its weight, increases cost and reduces its stretch due to the tricot construction and the spiral seams. Synthetic fibers were next used in cotton bale covers. U.S. Pat. No. 4,557,985 teaches the use of a woven polyolefin fabric with resin coating stripes to help reduce fraying as a cotton bale cover. This cover bag has good strength but is non-biodegradable, heavy and expensive to make since it has to be spiral-tubed. An in U.S. Pat. No. 5,104,703 the cotton bale fabric is a single layer nonwoven fiber blend of cotton and polypropylene. Here also the product is not biodegradable and is prepared by spiral tube sewing with reduced stretch in comparison to cotton covers.

The cotton bale cover bag of this invention is completely biodegradable, can easily be recycled due to its jersey stitch construction, has improved stretch and shape conformity characteristics, is light weight, has excellent strength and tear resistance since it has only one seam across the end or bottom portion as it is not spiral sewn and is economically attractive.

SUMMARY OF THE INVENTION

The invention is a cotton bale cover comprising a fabric circular knitted from yarn consisting essentially of cotton fibers, the fabric being circular weft knit in jersey stitch construction from open end spun yarn having a yarn content of from about 12 singles to 10 singles, the cover having a weight of from about 2 to 2.5 pounds (0.906 kg to 1.13 kg ) for gin standard density bales or gin universal density bales at 8.5 percent moisture content and having elongation and bursting strength characteristics sufficient to withstand storage and transportation stress.

DESCRIPTION OF THE PREFERRED EMBODIMENTS

Figure 1:
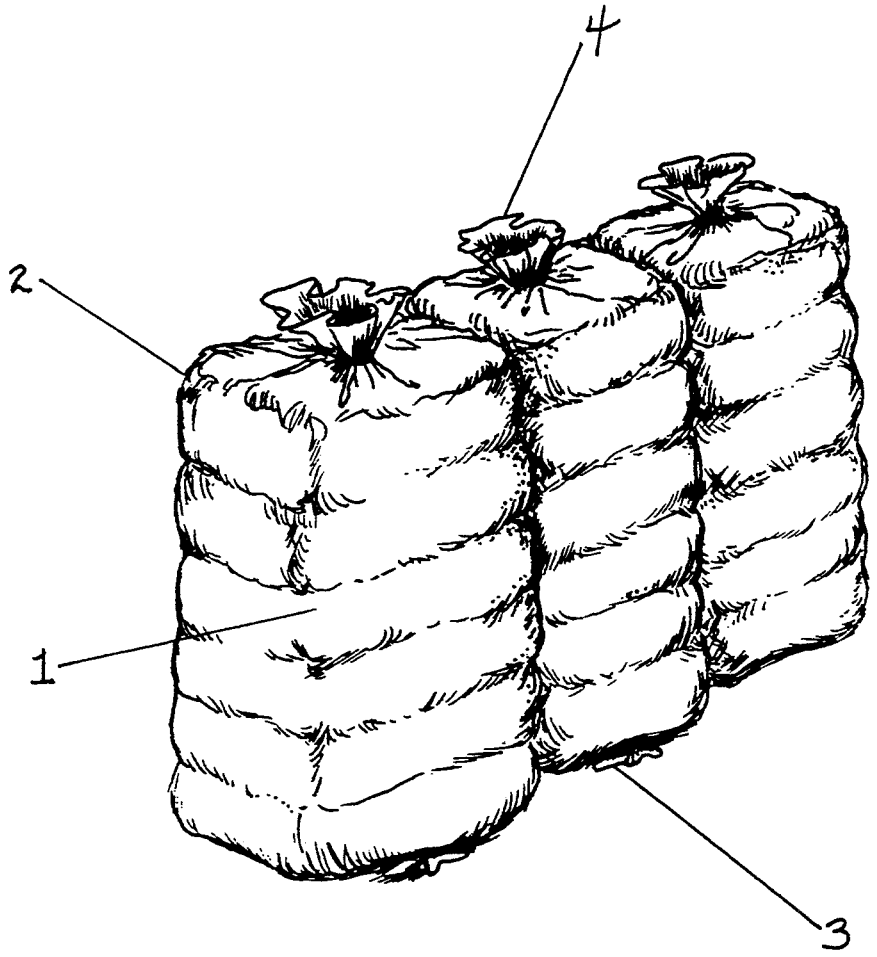
FIGURE 1 is a perspective view illustrating the cover of the invention in place over a universal density cotton bale.

It has been found that circular knit cotton fabric is especially and uniquely suitable for use as a cotton bale cover. The flat knit or warp knit fabrics of the prior art have a number of disadvantages in comparison to circular knit fabrics as cotton bale covers. A flat or warp knit fabric must be pattern sewn in order to fit properly and sacrifices weight in order to achieve equivalent strength. Circular knitting machines are used to prepare a number of different fabric types such as jersey, rib, interlock or double rib and terry all of which may be used to make cotton bale covers. However, jersey fabric is preferred since it has the advantage over other circular knit fabrics of light weight combined with suprisingly good strength and elongation or elasticity. Rib fabric has good elasticity but requires a finer yarn to achieve it thus reducing strength and tear resistance. Interlock fabric is heavier and thicker than jersey which reduces stretch and elasticity. The jersey fabric gives best results when circular knit from cotton yarn preferably having a yarn content of from about 12 singles to 10 singles. Yarn having a yarn content of 18 singles or higher produces a jersey fabric having greatly reduced performance. The jersey fabric can be prepared with 30 to 40 stiches per inch (2.54 cm) preferably 36 stitches per inch. The cotton yarn can be spun by any of the well known cotton yarn spinning methods, such as open end or ring spinning.

The jersey fabric of the invention is highly desirable for use on universal density (UD) cotton bales. Recent improvements in cotton bale compression equipment have resulted in cotton bales having greatly reduced size with equivalent weight of the older well known bales. The UD bales have a cotton bale density of at least 28 pounds per cubic foot (448.5 kg per cubic meter) with the same weight as the standard density (SD) bale of about 550 pounds (249 kg), the SD bale having a cotton bale density of between about 23 pounds and 28 pounds per cubic foot (368.4 and 448.5 kg per cubic meter ). The higher density reduces the size of the UD bale substantially allowing better storage and transportation but creates problems in bale cover construction which have been solved by the jersey fabric of this invention.

In the embodiment of the invention shown in FIGURE 1 a series of UD bales 1 are depicted in storage position with jersey fabric bale cover bags 2 in secured position enclosing each bale. End or bottom seam 3 and top flap 4 loosely tied at the top complete the enclosure of each bale.

The invention is further illustrated by the following examples of specific embodiments of the invention.

EXAMPLE 1

A 30 inch (76.2 cm) 16 cut circular knitting machine was supplied with open end spun waxed cotton yarn having a yarn content of 12 singles and adjusted for jersey stitch. The resulting jersey fabric was used to prepare a cotton bale cover bag approximately 8 feet (2.44 meters) long and 3 feet (0.914 meters) wide designed to fit a universal density cotton bale. A UD cotton bale was fitted with the bag and subjected to impact and tear resistance testing. No appreciable tears or loss of shape were observed in the bag after numerous test drops.

EXAMPLE 2

The procedure of Example 1 was repeated with the exception that the yarn content was 18 singles. The bag did not properly conform to the shape of the UD bale and some tears and rips were observed after only a few test drops.

EXAMPLE 3

The procedure of Example 1 was repeated with the knitting machine adjusted for interlock stitch. The interlock fabric bag when stretched in an attempt to fit a UD bale lost a part of its elasticity and resulted in an undesirable loose fit.

While preferred embodiments of the invention have been described, such description is for illustrative purposes only, and it is to be understood that changes and variations may be made without departing from the spirit or scope of the claims.

We claim:

1. A cotton bale enclosed within a cotton bale bag, said bag comprising a fabric circular knitted in a jersey stitch fabric construction from yarn consisting essentially of cotton fibers.

2. The bale of claim 1 wherein the bale is a universal density bale having a cotton bale density of at least about 28 pounds per cubic foot.

3. The bale of claim 1 wherein the bale is a standard density bale having a cotton bale density of between about 23 and 28 pounds per cubic foot.

4. The bale of claim 1 wherein the fabric is circular weft knitted.

5. The bale of claim 1 wherein the yarn has a yarn content of from about 12 to 10 singles.

6. The bale of claim 1 wherein the yarn is open end spun and has a yarn content of 12 singles.

7. The bale of claim 1 wherein the bag has a weight of from about 2.0 to 2.5 pounds based on 8.5 percent moisture content.

* * * * *